US010882330B2

(12) United States Patent
Komagome et al.

(10) Patent No.: US 10,882,330 B2
(45) Date of Patent: Jan. 5, 2021

(54) PRINTER

(71) Applicant: SATO HOLDINGS KABUSHIKI KAISHA, Tokyo (JP)

(72) Inventors: Shun Komagome, Tokyo (JP); Yukimasa Saito, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/331,682

(22) PCT Filed: Aug. 28, 2017

(86) PCT No.: PCT/JP2017/030689
§ 371 (c)(1),
(2) Date: Mar. 8, 2019

(87) PCT Pub. No.: WO2018/066265
PCT Pub. Date: Apr. 12, 2018

(65) Prior Publication Data

US 2019/0240991 A1 Aug. 8, 2019

(30) Foreign Application Priority Data

Oct. 5, 2016 (JP) ..... 2016-197480

(51) Int. Cl.

| | |
|---|---|
| ***B41J 2/32*** | (2006.01) |
| ***B41J 2/355*** | (2006.01) |
| ***B41J 25/304*** | (2006.01) |
| ***B41J 2/33*** | (2006.01) |
| ***B41J 29/56*** | (2006.01) |
| ***B41J 29/13*** | (2006.01) |
| ***B41J 2/35*** | (2006.01) |

(52) U.S. Cl.
CPC ..... *B41J 2/355* (2013.01); *B41J 2/32* (2013.01); *B41J 2/33* (2013.01); *B41J 2/35* (2013.01); *B41J 25/304* (2013.01); *B41J 29/13* (2013.01); *B41J 29/56* (2013.01)

(58) Field of Classification Search
CPC ..... B41J 2/32; B41J 2/33; B41J 25/304; B41J 29/13; B41J 29/56; B41J 2/355
See application file for complete search history.

(56) References Cited

U.S. PATENT DOCUMENTS

| | | | |
|---|---|---|---|
| 5,565,905 | A | 10/1996 | Kajiya et al. |
| 5,711,619 | A | 1/1998 | Kaneko et al. |
| 2003/0146968 | A1 | 8/2003 | Milto |

FOREIGN PATENT DOCUMENTS

| | | | |
|---|---|---|---|
| JP | 58-193172 | A | 11/1983 |
| JP | 62-146649 | A | 6/1987 |
| JP | 02-145359 | A | 6/1990 |
| JP | 04-366653 | A | 12/1992 |

(Continued)

OTHER PUBLICATIONS

Extended European Search Report, Application No. 17858104.7, dated Oct. 10, 2019, 7 pages.

*Primary Examiner* — Lamson D Nguyen
(74) *Attorney, Agent, or Firm* — Foley & Lardner LLP

(57) ABSTRACT

An embodiment of the present invention is a printer that includes a platen roller to feed a print medium, a print head to print on the print medium fed by the platen roller, a connector that is attachable and detachable with respect to the print head the print head, and a controller to stop power supply to the print head via the connector when the platen roller and the print head are separated.

17 Claims, 12 Drawing Sheets

(56) References Cited

FOREIGN PATENT DOCUMENTS

| | | | |
|---|---|---|---|
| JP | 07-256977 | A | 10/1995 |
| JP | 08-090871 | A | 4/1996 |
| JP | 2006-021438 | A | 1/2006 |
| JP | 2006-167943 | A | 6/2006 |
| JP | 2010-194782 | A | 9/2010 |
| JP | 2014-133364 | A | 7/2014 |

PRINTER

TECHNICAL FIELD

The present invention relates to printers.

BACKGROUND ART

Printers typically include a print head. Since a print head is a consumable, it needs replacing. It has been required to simplify the replacing of a print head. For instance, JP 2014-133364 A discloses a technique of simplifying the attachment and detachment of a print head and a connector.

SUMMARY OF THE INVENTION

Problems to be Solved by the Invention

When a user replaces a print head, they may connect a terminal of the print head and a terminal of a connector incorrectly. If such an incorrect connection occurs during the replacing of a print head while leaving the printer ON, overcurrent may flow through the electrical circuit of the print head. This causes short circuit of the print head.

Since JP 2014-133364 A does not consider such an incorrect connection of the print head and the connector, this technique cannot prevent short circuit of the print head due to the incorrect connection.

The present invention aims to prevent short circuit of a print head during the replacement of the print head.

Means for Solving the Problems

An embodiment of the present invention is a printer including:

a platen roller configured to feed a print medium;

a print head configured to print on the print medium fed by the platen roller;

a connector that is attachable and detachable with respect to the print head; and a controller configured to stop power supply to the print head via the connector when the platen roller and the print head are separated.

DETAILED DESCRIPTION OF THE INVENTION

Figure 1:
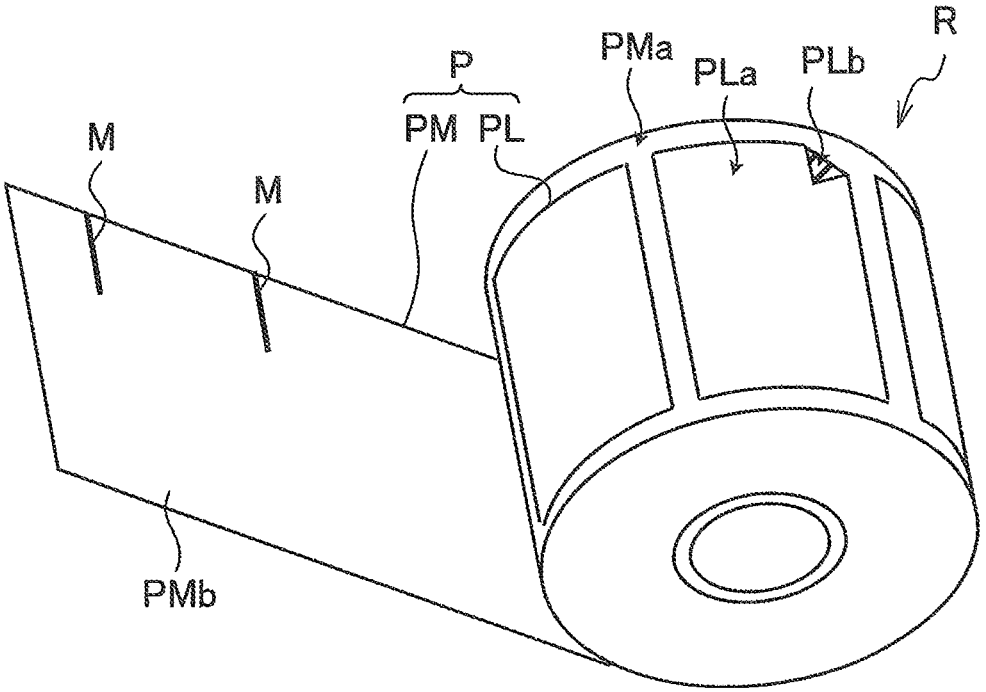
FIG. 1 schematically shows a print medium of the present embodiment.

The following describes one embodiment of the present invention in details, with reference to the drawings. In the drawings describing the embodiment, like numbers indicate like components, and their repeated description is omitted.

In the following description, "FR" refers to the front of a printer and "RR" refers to the rear of the printer. "UP" refers to the upward when the printer is placed on a horizontal plane, and "LO" refers to the downward when the printer is placed on the horizontal plane. "LH" and "RH" refer to the direction (hereinafter called a "width direction") orthogonal to the front-rear direction and the up-down direction of the printer.

A side of the printer closer to the container than any referential position on the feed path is called "upstream in the feeding direction". A side of the printer closer to the ejection port than the referential position is called "downstream in the feeding direction".

(1) PRINT MEDIUM

The following describes a print medium of the present embodiment. FIG. 1 schematically describes a print medium of the present embodiment.

As shown in FIG. 1, a print medium P of the present embodiment includes a liner PM and a plurality of labels PL. The liner PM has a temporary-adhesive face PMa on one side and a non-temporary-adhesive face PMb on the other side of the temporary-adhesive face PMa. The plurality of labels PL temporarily adheres to the temporary-adhesive face PMa at predetermined intervals. On the non-temporary-adhesive face PMb, reference marks M are formed at predetermined intervals. Each reference mark M shows the reference position for a label PL.

Each label PL has a print surface PLa and a sticking surface PLb. The print surface PLa includes a thermosensitive layer that develops a color by heat. On the sticking surface PLb, adhesive is applied.

(2) STRUCTURE OF PRINTER

Figure 2:
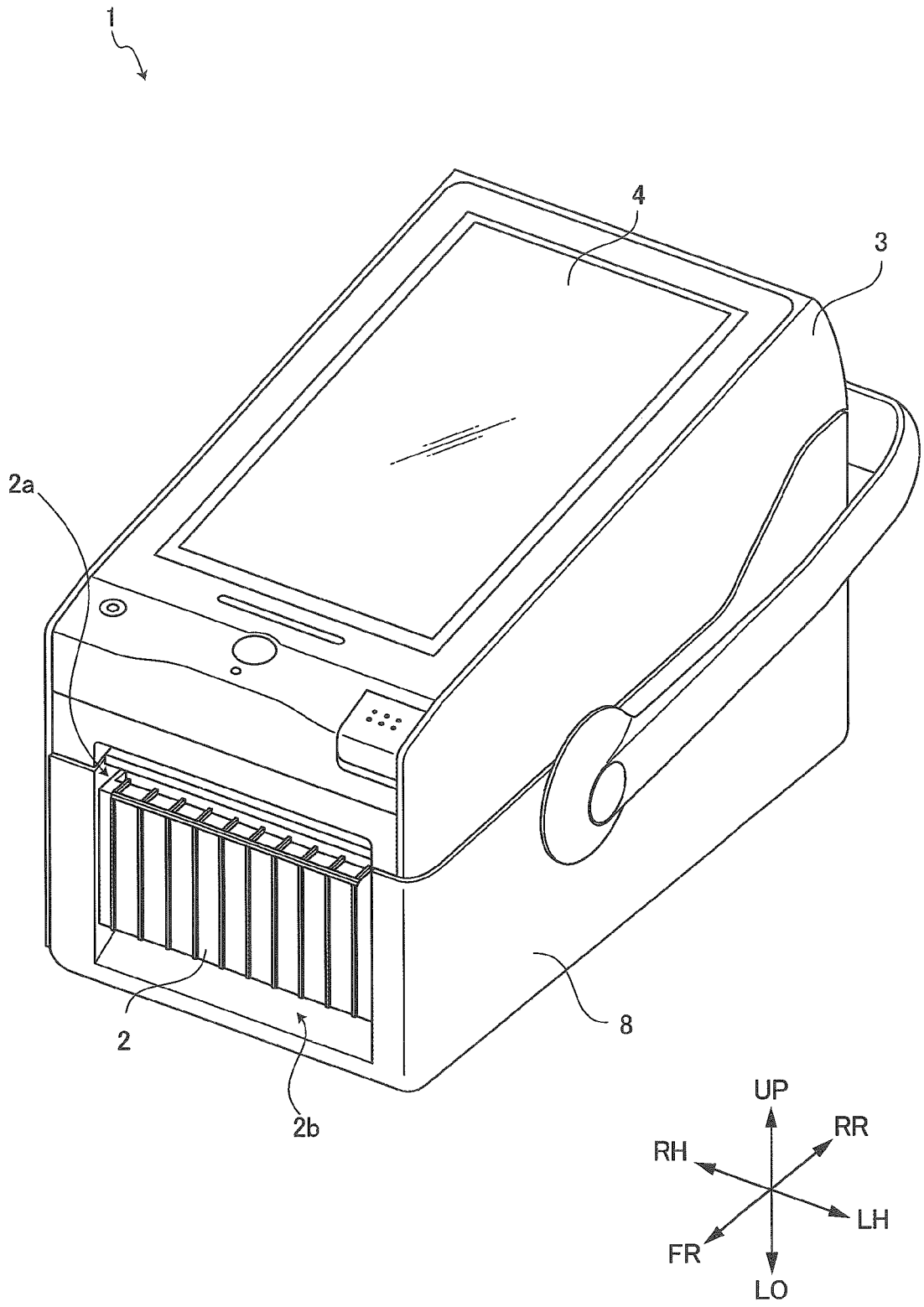
FIG. 2 is a perspective view of a printer of the present embodiment when the printer cover is at a closed position.
Figure 3:
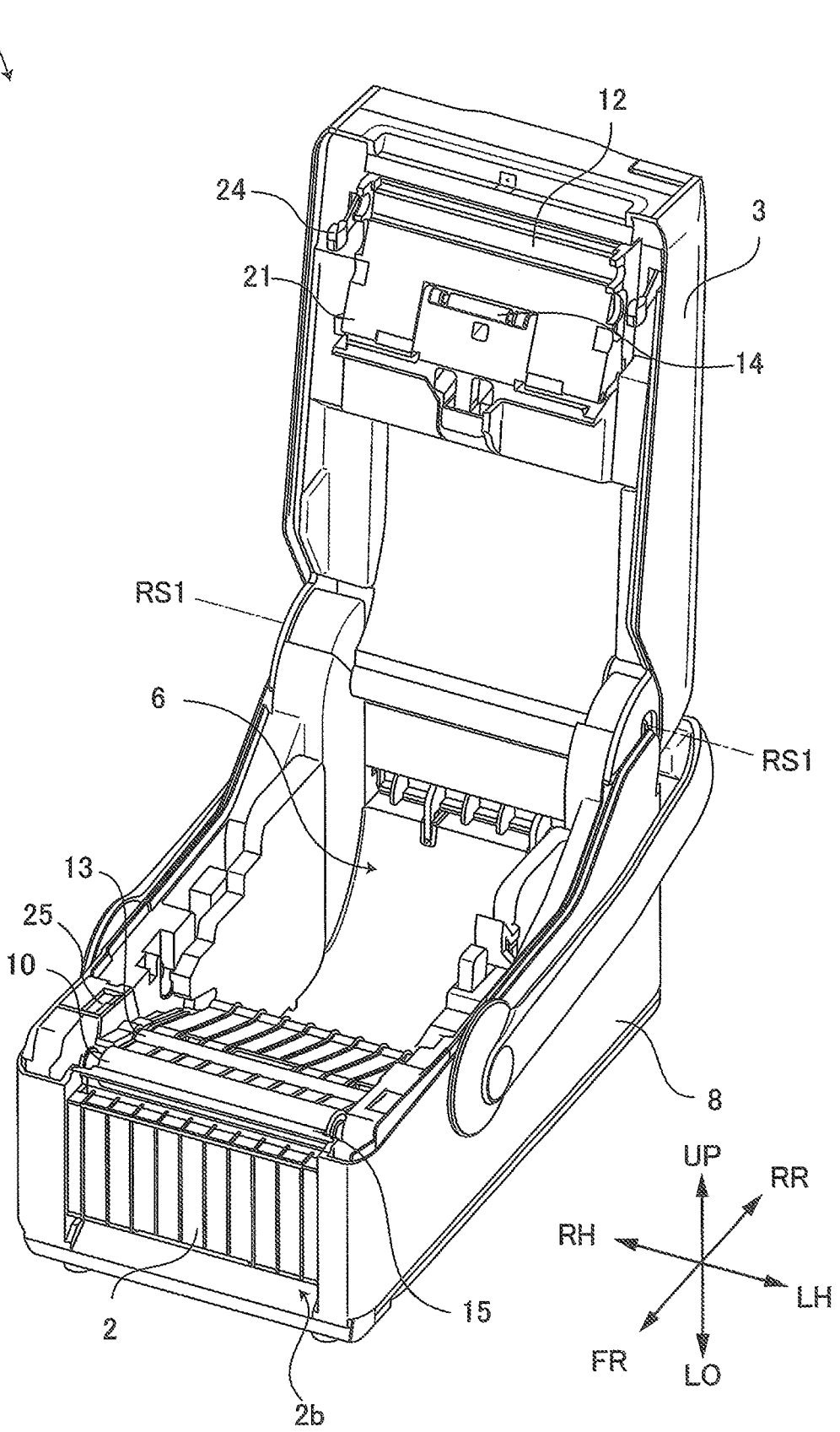
FIG. 3 is a perspective view of the printer of the present embodiment when the printer cover is at an open position and the head cover is at a shielding position.
Figure 4:
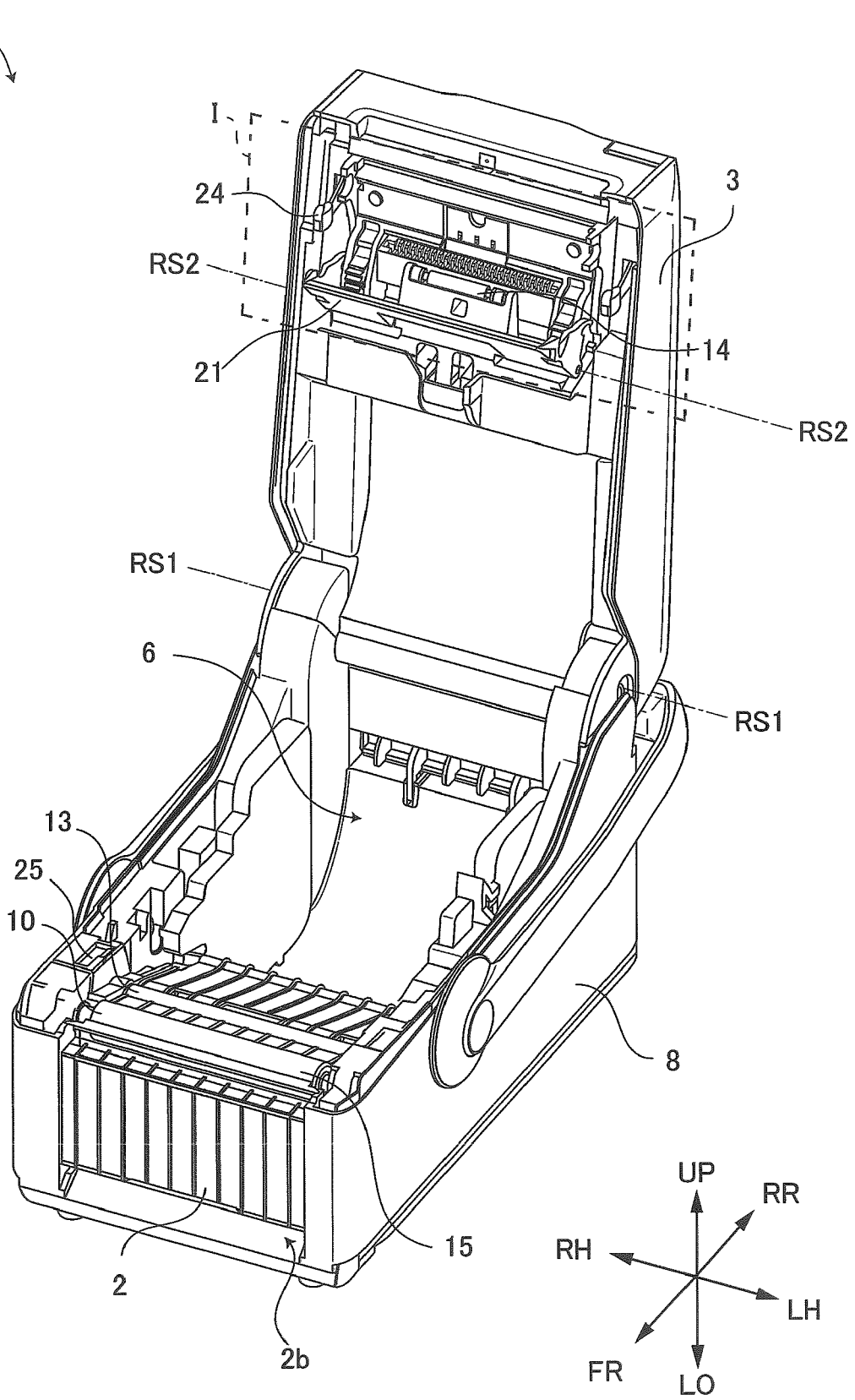
FIG. 4 is a perspective view of the printer of the present embodiment when the printer cover is at an open position and the head cover is at a not-shielding position.
Figure 5:
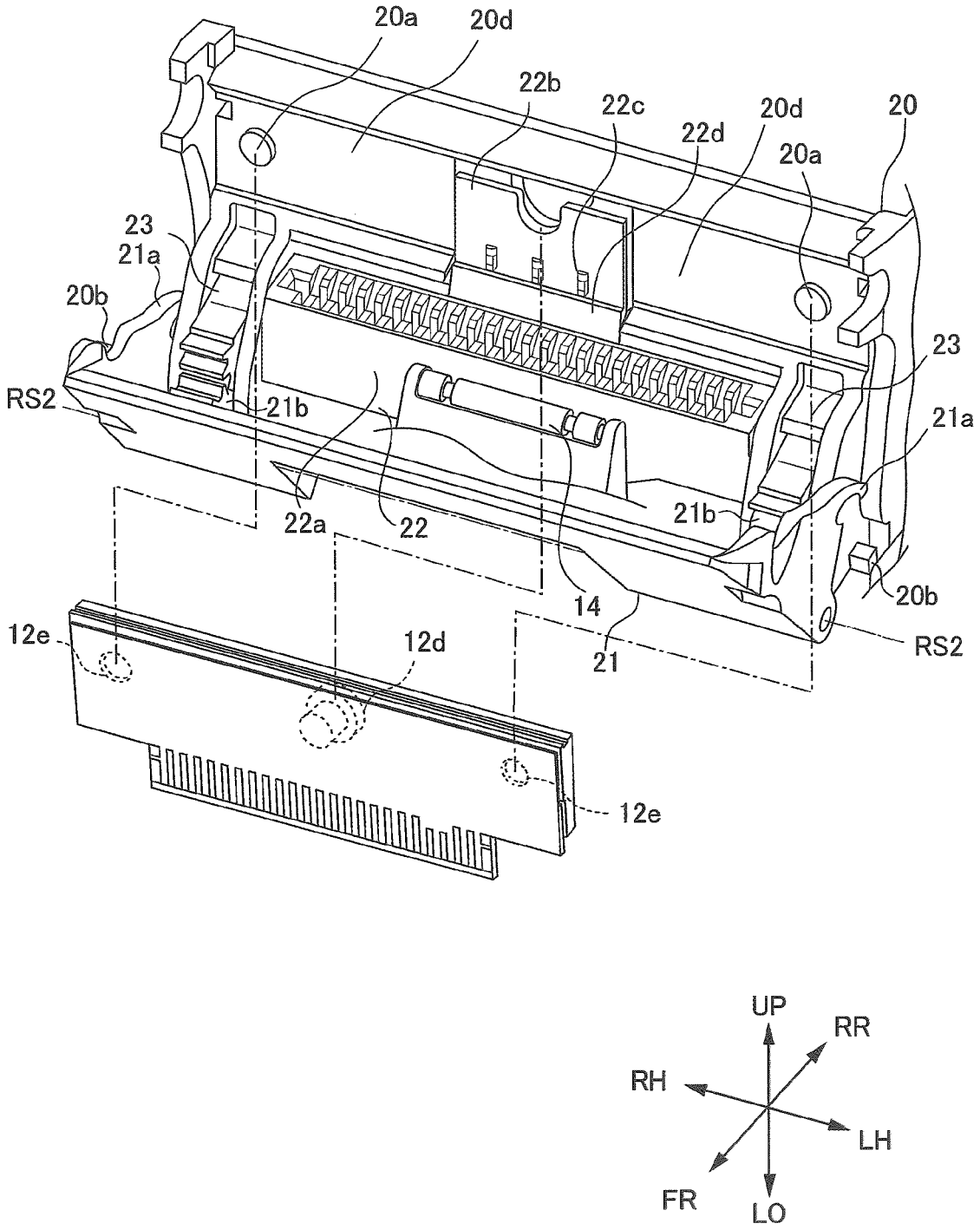
FIG. 5 is an enlarged perspective view of region I of FIG. 4.

The following describes the structure of a printer of the present embodiment. FIG. 2 is a perspective view of the printer of the present embodiment when the printer cover is at a closed position. FIG. 3 is a perspective view of the printer of the present embodiment when the printer cover is at an open position and the head cover is at a shielding position. FIG. 4 is a perspective view of the printer of the present embodiment when the printer cover is at an open position and the head cover is at a non-shielding position. FIG. 5 is an enlarged perspective view of region I of FIG. 4.

As shown in FIGS. 2 to 4, the printer 1 includes a front panel 2, a housing 8, a printer cover 3, a touch panel display 4, a container 6, a platen roller 10, a thermal head 12 (one example of a print head), a first assisting roller 13, a second assisting roller 14, a separator 15, a head cover 21, a pair of cover locks 24, and a pair of cover lock holes 25.

The printer cover 3 includes a cover open button 3*a* at the front end.

The rear end of the printer cover 3 is pivotally supported at the rear end of the housing 8. The printer cover 3 can move (i.e., is rotatable) relative to the housing 8 between the closed position (FIG. 2) and the open position (FIG. 3) about the rotary shaft RS1.

At the closed position, the printer cover 3 closes the housing 8 (for example, the interior of the housing 8 cannot be seen from the outside of the printer 1). At the open position, the printer cover 3 opens the housing 8 (for example, the interior of the housing 8 can be seen from the outside of the printer 1). When the printer cover 3 is at the closed position, the platen roller 10 and the thermal head 12 are opposed. When the printer cover 3 rotates from the closed position to the open position, the front end of the printer cover 3 rotates away from the front panel 2 and the front end of the housing 8. When the printer cover 3 rotates from the open position to the closed position, the front end of the printer cover 3 rotates toward the front panel 2 and the front end of the housing 8. When the printer cover 3 is at the open position, the thermal head 12 is away from the platen roller 10. The printer cover 3 has a front face. The front face is directed upward (UP) when the printer cover 3 is at the closed position. The front face is directed rearward (RR) when the printer cover 3 is at the open position.

The printer cover 3 has a rear face. The rear face is directed downward (LO) when the printer cover 3 is at the closed position. The rear face is directed forward (FR) when the printer cover 3 is at the open position.

Located in the housing 8 are: the front panel 2, the container 6, the first assisting roller 13, the platen roller 10, the separator 15 and the pair of cover lock holes 25.

The container 6 is located closer to the rear end of the housing 8. The container 6 stores a roll of paper R. As shown in FIG. 3, when the printer cover 3 is at the open position, the container 6 is accessible from the outside of the printer 1. Then a user can set a roll of paper R into the container 6.

The platen roller 10 is located forward (FR) of the first assisting roller 13. The platen roller 10 is rotatably supported at the housing 8. The platen roller 10 is connected to a stepping motor (not illustrated). The platen roller 10 rotates under the control of the stepping motor so as to feed the print medium P.

The first assisting roller 13 is located forward (FR) of the container 6. The first assisting roller 13 is rotatably supported at the housing 8.

The separator 15 is located forward (FR) of the platen roller 10. The separator 15 is a member (e.g., a separation board) having at least one plane or a member (e.g., a separation pin) having at least one curved surface. When the platen roller 10 feeds a print medium P forward (FR), the separator 15 folds back the liner PM of the print medium downward (LO) and rearward (RR) so as to separate the printed label PL from the liner PM.

As shown in FIG. 2, a label ejection port 2*a* is defined between the printer cover 3 at the closed position and the housing 8 (i.e., above (UP) the front panel 2). Below (LO) the front panel 2, a liner ejection port 2*b* is defined.

The label ejection port 2*a* is located forward (FR) of the separator 15. The label ejection port 2*a* ejects a label PL separated from the liner PM.

The liner ejection port 2*b* is located below (LO) the label ejection port 2*a*. The liner ejection port 2*b* ejects the liner PM after a label PL is separated from the liner PM.

As shown in FIG. 2, when the printer cover 3 is at the closed position, the touch panel display 4 is located at the upper face of the printer cover 3. The touch panel display 4 displays predetermined information. The predetermined information contains information on the printer 1 and images of operation keys. When a user touches an image of an operation key, the processor (which will be described later) of the printer 1 receives an instruction corresponding to the operation key. The touch panel display 4 is a liquid crystal display having a touch sensor, for example.

As shown in FIGS. 3 to 5, the cover open button 3*a*, the thermal head 12, the second assisting roller 14, a head bracket 20, the head cover 21, a connector unit 22 (one example of a connector), a pair of gears 23, and the pair of cover locks 24 are attached to the printer cover 3. When the printer cover 3 is at the closed position, the thermal head 12, the second assisting roller 14, the head bracket 20, the head cover 21, the connector unit 22, and the pair of gears 23 are located on the lower face of the printer cover 3.

As shown in FIGS. 3 and 4, the head cover 21 is pivotally supported at the printer cover 3. The head cover 21 can move (i.e., rotate) relative to the printer cover 3 between a shielding position (one example of a first position) of FIG. 3 and a non-shielding position (one example of a second position) of FIG. 4 about the rotary shaft RS2. The rotary shaft RS2 is parallel to the rotary shaft RS1.

The head cover 21 at the shielding position shields a part of the thermal head 12. In this case, a part of the thermal head 12 and the connector unit 22 (see FIG. 4) are covered by the head cover 21, and therefore, they cannot be seen from the outside of the printer 1.

The head cover 21 at the non-shielding position opens the connector unit 22. Specifically, a space is defined between the head cover 21 at the non-shielding position and the printer cover 3. The connector unit 22 is exposed through this space. The connector unit 22 has a connecting terminal, and the connecting terminal is directed upward (UP). In this case, the thermal head 12 and the connector unit 22 can be seen from the outside of the printer 1.

The second assisting roller 14 is rotatably supported at the printer cover 3. The second assisting roller 14 is located at a center of the head cover 21 in the width direction (LH-RH direction). The second assisting roller 14 assists the feeding of the print medium P by being rotated in response to the rotation of the first assisting roller 13.

When the printer cover 3 is at the closed position as shown in FIG. 2, the pair of cover locks 24 in FIG. 3 is inserted into the pair of cover lock holes 25. This fixes the printer cover 3 at the closed position. When the user presses the cover open button 3*a*, the fixing by the cover locks 24 is cancelled. As a result, the printer cover 3 can rotate from the closed position to the open position (FIG. 3).

As shown in FIG. 5, the head bracket 20 includes a pair of projections 20*a*, a pair of protrusions 20*b* and a head bracket body 20*d*.

The pair of projections 20*a* protrudes forward (FR) from the head bracket body 20*d*.

The head cover 21 includes a pair of engagement parts 21*a* and a pair of gears 21*b*.

The pair of engagement parts 21*a* is located at lateral ends of the head cover 21. The pair of engagement parts 21*a* engages with the pair of protrusions 20*b*, whereby the head cover 21 can be locked at the shielding position (FIG. 3).

When a user rotates the head cover 21, the engagement of the pair of engagement parts 21*a* with the pair of protrusions 20*b* is cancelled.

As shown in FIG. 5, the pair of gears 23 engages with a pair of engagement holes 22*f* and the pair of gears 21*b*. Such engagement via the pair of gears 23 converts the rotary motion of the head cover 21 into the motion of the connector unit 22 in the up-down direction (UP-LO direction).

That is, a gear mechanism is made up of the pair of gears 21*b* and the pair of gears 23, and this gear mechanism is a moving mechanism to join with the connector unit 22 and the head cover 21. As the head cover 21 moves, this moving mechanism moves the connector unit 22 (e.g., slides the connector unit 22 in the up-down direction (UP-LO direction)) for attachment and detachment of the thermal head 12 and the connector unit 22.

The thermal head 12 is attachable and detachable with respect to the connector unit 22.

The connector unit 22 is configured to connect the thermal head 12 to a control board (not illustrated).

Figure 6:
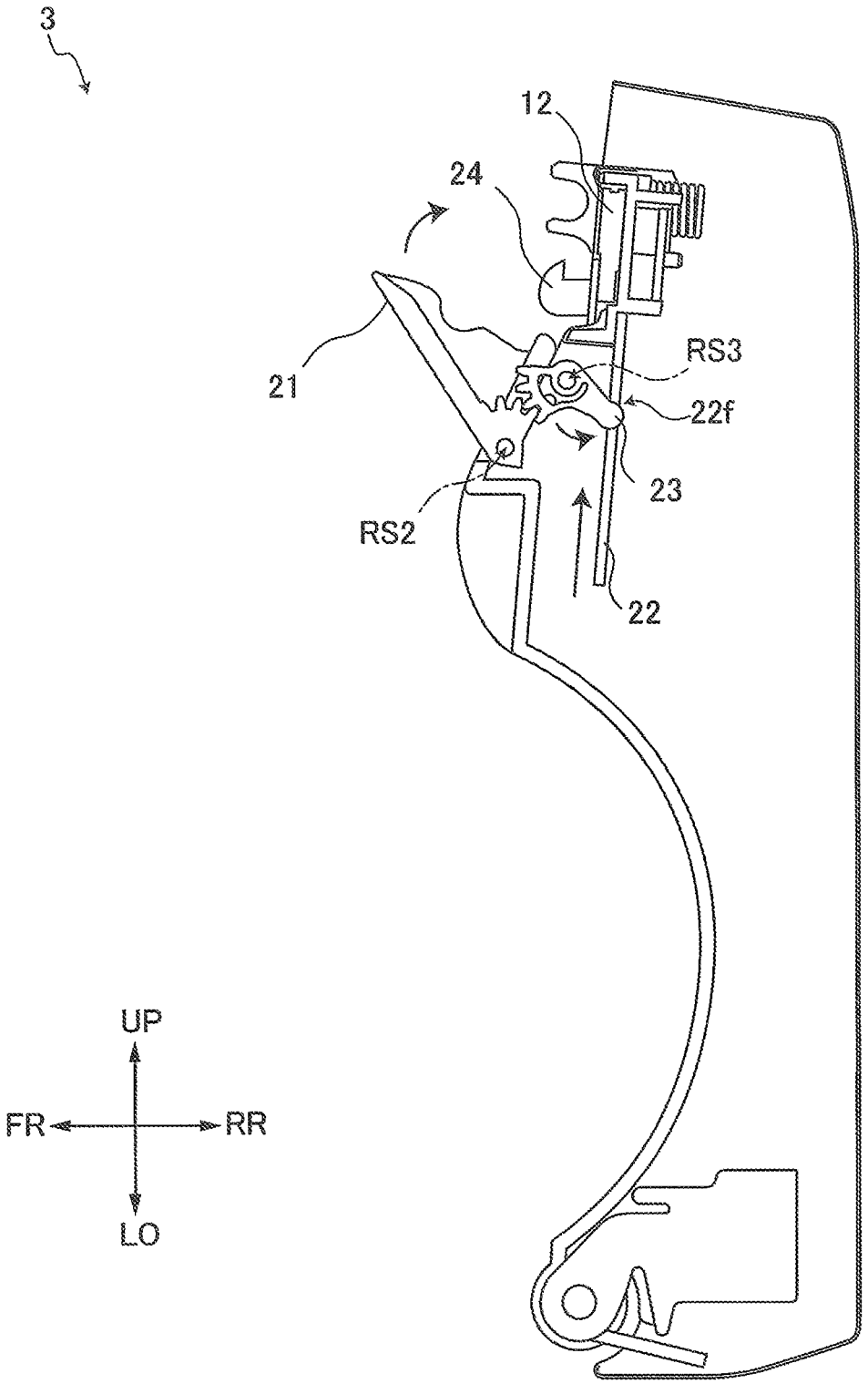
FIG. 6 explains how to attach and detach the thermal head and the connector unit of the present embodiment.
Figure 7:
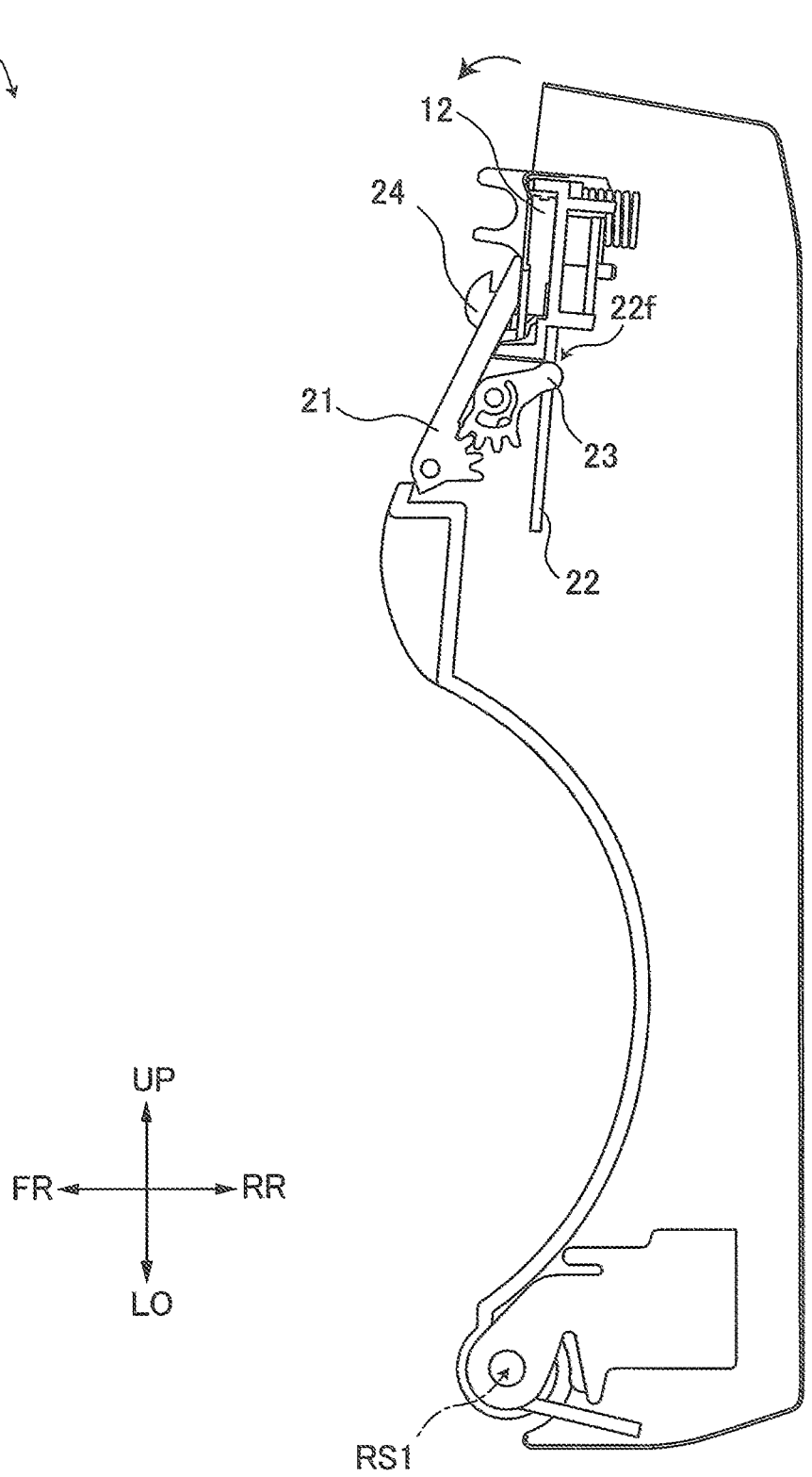
FIG. 7 explains how to attach and detach the thermal head and the connector unit of the present embodiment.
Figure 8:
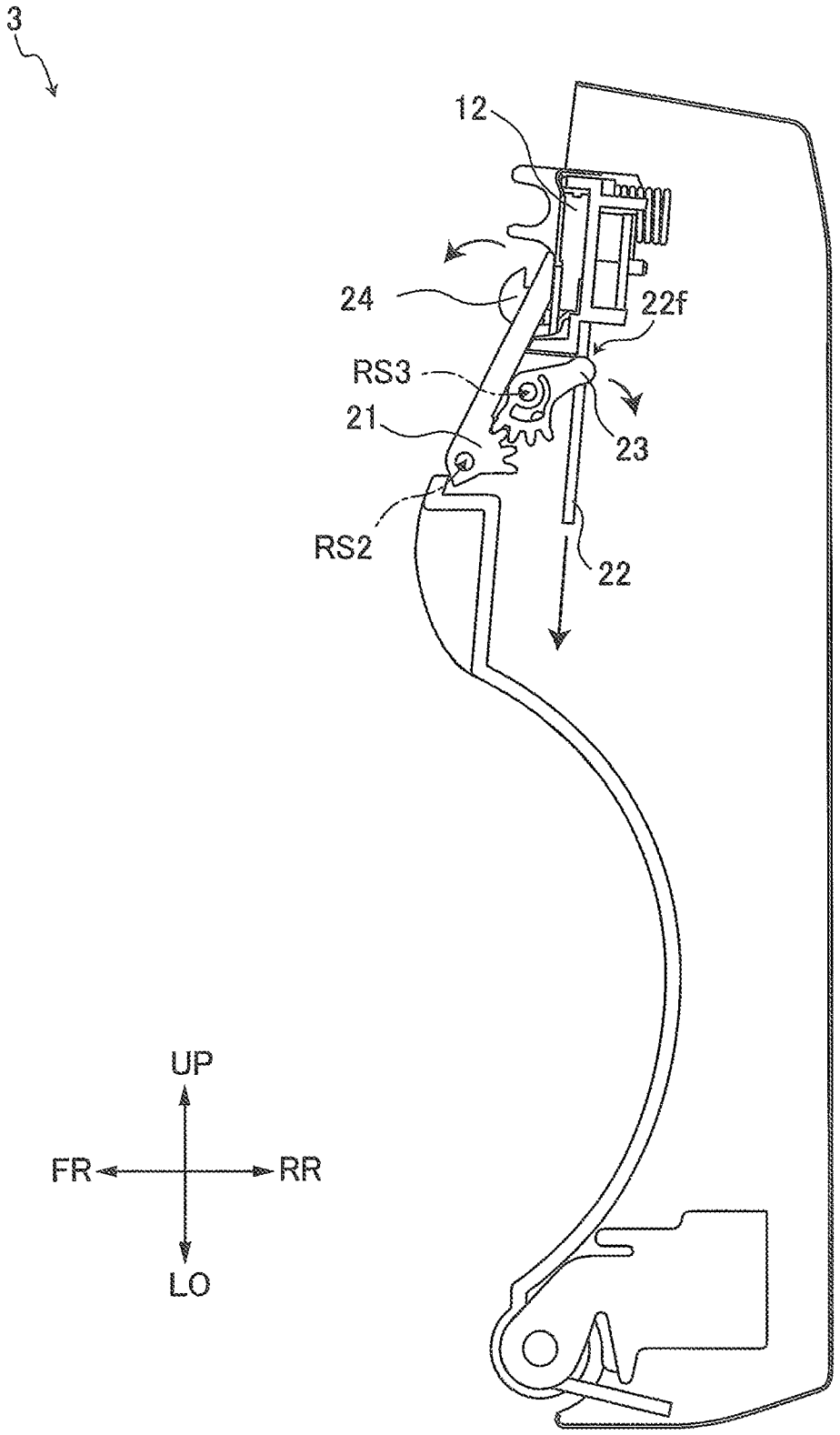
FIG. 8 explains how to attach and detach the thermal head and the connector unit of the present embodiment.

(3) Attachment and detachment of thermal head and connector unit. The following describes attachment and detachment of the thermal head and the connector unit of the present embodiment. FIGS. 6 to 8 explain how to attach and detach the thermal head and the connector unit of the present embodiment.

FIGS. 6 to 8 show the cross section of a major part of the printer cover 3 at the open position (FIG. 3).

As shown in FIG. 6, when the printer cover 3 is at the open position and the head cover 21 is at the non-shielding position, the thermal head 12 is open. At this time, the thermal head 12 can be seen from the forward (FR) of the printer cover 3.

When the user rotates the head cover 21 clockwise (FIG. 6) about the rotary shaft RS2, the gears 23 rotate counterclockwise (FIG. 6) about the rotary shaft RS3. The gears 23 rotated counterclockwise push the engagement holes 22*f* upward (UP) so as to move the connector unit 22 upward (UP) (i.e., in the direction closer to the thermal head 12 held by the head bracket 20).

As a result, as shown in FIG. 7, the head cover 21 moves to the shielding position. This connects the thermal head 12 to the connector unit 22.

Next, when the user rotates the printer cover 3 counterclockwise (FIG. 7) about the rotary shaft RS1, the printer cover 3 moves to the closed position (FIG. 2).

When the user rotates the head cover 21 at the shielding position (FIG. 7) counterclockwise (FIG. 8) about the rotary shaft RS2, the gears 23 rotate clockwise (FIG. 8) about the rotary shaft RS3. The gears 23 rotated clockwise push the engagement holes 22*f* downward (LO) so as to move the connector unit 22 downward (LO) (i.e., in the direction away from the thermal head 12 held by the head bracket 20).

As a result, as shown in FIG. 6, the head cover 21 moves to the non-shielding position. This detaches the thermal head 12 from the connector unit 22.

(4) FUNCTIONAL BLOCK

Figure 10:
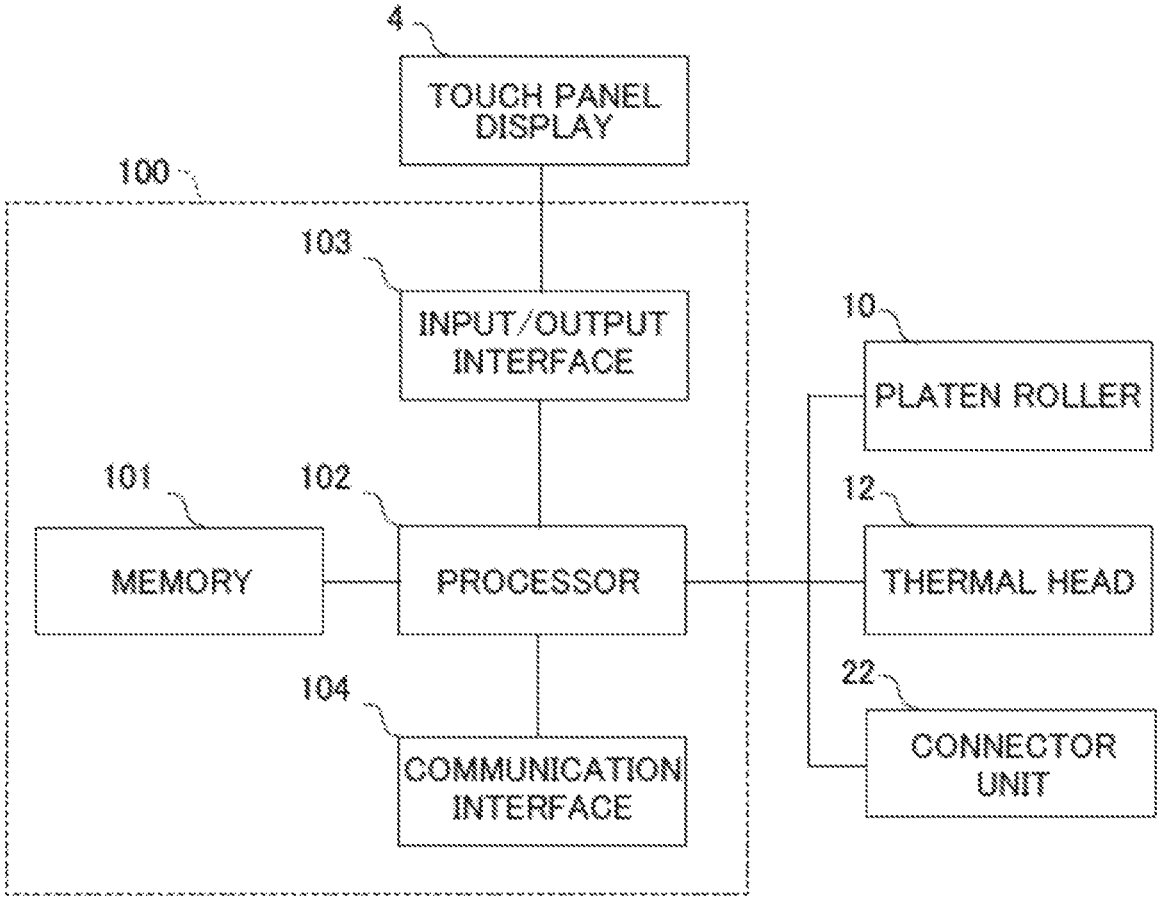
FIG. 10 is a functional block diagram of the printer of the present embodiment.

The following describes the functional block of a printer of the present embodiment. FIG. 10 is a functional block diagram of the printer of the present embodiment.

As shown in FIG. 10, the printer includes a control board 100, and the control includes a memory 101, a processor 102 (one example of a controller), an input/output interface 103, and a communication interface 104.

The memory 101 stores programs and data. The memory 101 may be the combination of a Read Only Memory (ROM), a Random Access Memory (RAM), and a storage (e.g., a flash memory or a hard disk drive), for example. The programs contain firmware and software. The firmware is a program to control the hardware of the printer 1. The software is a program to implement the functions of the printer 1. The data includes control data referred to by the firmware and processing data referred to by the software.

The processor 102 starts a program stored in the memory 101 and refers to data stored in the memory 101 so as to implement the functions of the printer 1. Specifically, the processor 102 implements a communication control function, a display control function, an instruction receiving function, a print control function and a power control function. The processor 102 may be a Central Processing Unit (CPU), for example.

The processor 102 implementing a communication control function controls a communication between the printer 1 and a device connected to the printer 1 (e.g., a smartphone, a tablet, a personal computer, or a server) via the communication interface 104. The communication control function connects the printer 1 to a network (e.g., the internet, intranet, local area network, or a combination of them).

The processor 102 implementing a display control function displays information to be displayed on the touch panel display 4 via the input/output interface 103.

When the user touches one of the operation key images displayed on the touch panel display 4, the processor 102 implementing an instruction receiving function receives an instruction corresponding to the operation key image touched by the user via the input/output interface 103.

The processor 102 implementing a print control function controls the driving of the stepping motor (i.e., the rotation of the platen roller 10) and heat generation of the thermal head 12.

The input/output interface 103 receives an instruction from a user through an input device (e.g., the touch panel display 4) of the printer 1 and outputs information to an output device (e.g., the touch panel display 4) of the printer 1.

The communication interface 104 controls a communication between the printer 1 and a device connected to the printer 1.

The processor 102 implementing a power control function controls the power supply to the thermal head 12 via the connector unit 22.

(4-1) Print Control Function

Figure 9:
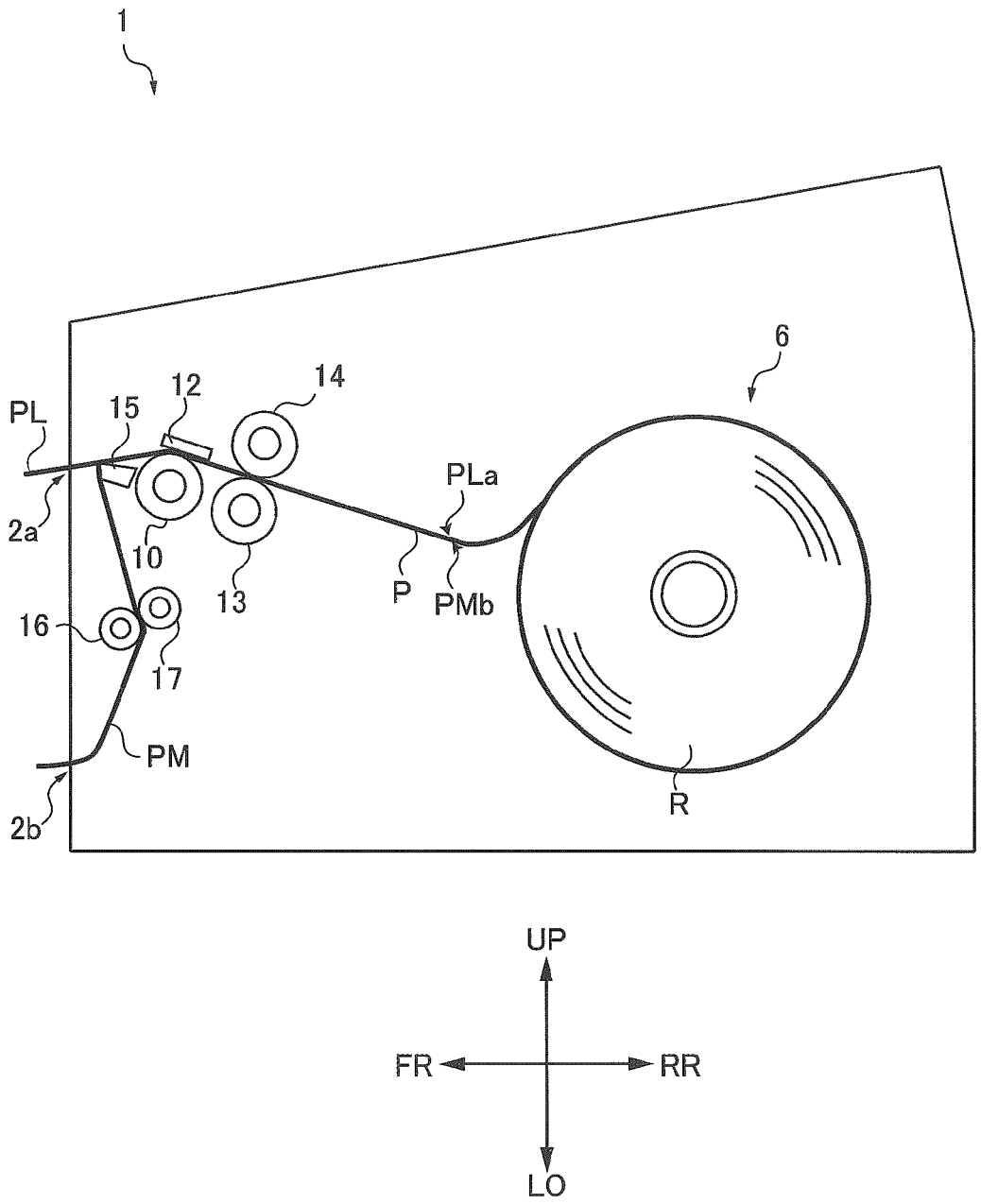
FIG. 9 schematically shows a feed path of the present embodiment.

The following describes a print control function of the present embodiment. FIG. 9 schematically shows the feed path of the present embodiment.

As shown in FIG. 9, the feed path of the print medium P is a path between the container 6 and the separator 15. The feed path of the print medium P extends through the first assisting roller 13, the second assisting roller 14, the thermal head 12 and the platen roller 10. The feed path of the labels PL is a path between the separator 15 and the label ejection port 2*a*. The feed path of the liner PM is a path between the separator 15 and the liner ejection port 2*b*. The feed path of the liner PM extends through a first nip roller 16 and a second nip roller 17.

The container 6 stores a roll of paper R.

The first assisting roller 13 and the second assisting roller 14 are located downstream of the container 6 in the feeding direction. The first assisting roller 13 is located under (LO) the feed path. The second assisting roller 14 is located above (UP) the feed path. That is, when the printer cover 3 is at the closed position (FIG. 2), the first assisting roller 13 and the second assisting roller 14 are opposed. The first assisting roller 13 is connected to a stepping motor. The first assisting roller 13 rotates under the control of the stepping motor. The second assisting roller 14 rotates following the rotation of the first assisting roller 13. The first assisting roller 13 and the second assisting roller 14 rotate while sandwiching the print medium P therebetween so as to assist the feeding of the print medium P.

The platen roller 10 and the thermal head 12 are located downstream of the first assisting roller 13 and the second assisting roller 14 in the feeding direction. The platen roller 10 is located below (LO) the feed path.

The thermal head 12 is located above (UP) the feed path. That is, when the printer cover 3 is at the closed position (FIG. 2), the platen roller 10 and the thermal head 12 are opposed.

The separator 15 is located downstream of the platen roller 10 and the thermal head 12 in the feeding direction. The upper face and the front face of the separator 15 define a sharp angle.

The first nip roller 16 and the second nip roller 17 are located downstream of the separator 15 in the feeding direction. The first nip roller 16 and the second nip roller 17 are opposed. The first nip roller 16 rotates following the rotation of the second nip roller 17. The second nip roller 17 is connected to a stepping motor. The second nip roller 17 rotates under the control of the stepping motor. The first nip roller 16 and the second nip roller 17 rotate while sandwiching the liner PM therebetween so as to feed the liner PM from the separator 15 to the liner ejection port 2*b*.

As the platen roller 10 rotates forward (counterclockwise in FIG. 6), a belt-like print medium P (the combination of labels PL and liner PM) is extracted from the container 6 to the downstream of the container 6 in the feeding direction. The lower face of the extracted print medium P is the non-temporary-adhesive face PMb of the liner PM. The upper face of the extracted print medium. P is the print surface. PLa.

As the platen roller 10 rotates forward, the first assisting roller 13 rotates counterclockwise in FIG. 6 while having a contact with the non-temporary-adhesive face PMb. At the same time, the second assisting roller 14 rotates clockwise in FIG. 6 while having a contact with the print surface PLa.

The print medium P extracted from the container 6 passes through between the platen roller 10 and the thermal head 12 while having a contact with the second assisting roller 14 at the print surface PLa (i.e., the upper face of the print medium P) and having a contact with the first assisting roller 13 at the non-temporary-adhesive face PMb (i.e., the lower face of the print medium P).

The processor 102 receives print data corresponding to information (hereinafter called "print information") to be printed on the print surface PLa in response to a user's instruction. The processor 102 controls the heater elements to generate heat in accordance with the print data.

When the print medium P passes through between the thermal head 12 and the platen roller 10, the heater elements generating heat are pressed against the print surface PLa. Due to the heat of the heater elements, the thermosensitive layer at the print surface PLa develops a color. As a result, print information is printed on the print surface PLa.

The label PL is fed from the front end of the separator 15 to the label ejection port 2*a*. The liner PM is folded back downward (LO) and rearward (RR) along the front face of the separator 15, and then is fed toward the liner ejection port 2*b*. That is, the separator 15 folds hack the liner PM at a sharp angle relative to the label PL. As a result, the separator 15 separates the label PL from the liner PM.

The label ejection port 2*a* ejects the label PL separated from the liner PM. The liner PM after the label PL is separated (i.e., the liner PM passing through the front end of the separator 15) passes through between the first nip roller 16 and the second nip roller 17, and then is ejected from the liner ejection port 2*b*.

(4-2) Power Control Function

The following describes a power control function of the present embodiment.

The processor 102 of the present embodiment is configured to stop power supply to the print head via the connector unit 22 when the platen roller 10 and the thermal head 12 are separated. The following describes examples of the power control function when the processor 102 stops the power supply to the thermal head 12.

(4-2-1) First Example of Power Control Function

The following describes a first example of the power control function of the present embodiment.

As shown in FIG. 8, when the thermal head 12 is detached from the connector unit 22 while leaving the printer 1 ON, the thermal head 12 is separated from the platen roller 10. In this case, the processor 102 stops the power supply to the thermal head 12 via the connector unit 22.

Specifically, the processor 102 is configured to detect whether the thermal head 12 and the connector unit 22 are connected or not. When the processor 102 detects the thermal head 12 not connecting to the connector unit 22 (i.e., separating of the platen roller 10 from the thermal head 12), the processor 102 stops the power supply to the thermal head 12.

After stopping the power supply, a user replaces the thermal head 12. During the replacement, the user may connect a connector 12*b* of a new thermal head 12 to an incorrect terminal 22*a* (i.e., incorrect connection may occur). In case of such an incorrect connection, no current flows through the thermal head 12 because power supply to the thermal head 12 is stopped. This can prevent short circuit of the thermal head 12 during the replacement of the thermal head 12.

When the thermal head 12 is connected to the connector unit 22 as shown in FIG. 7, the processor 102 restarts the power supply to the thermal head 12 via the connector unit 22 after the connection of the thermal head 12 to the connector unit 22. That is, the user can restart the power supply to the thermal head 12 simply by moving the head cover 21 to the shielding position. Therefore, any instruction to restart the power supply (e.g., an instruction using an operation key image) is not required. This can reduce the user's labor to replace the thermal head 12.

(4-2-2) Second Example of Power Control Function

The following describes a second example of the power control function of the present embodiment. In this second example, the processor 102 stops the power supply to the print head via the connector unit 22 when the platen roller 10 and the thermal head 12 are separated.

When the printer cover 3 is at the closed position as shown in FIG. 2, the user presses the cover open button 3*a* to cancel the fixing by the cover locks 24. Then when the user rotates the printer cover 3 toward the open position (FIG. 3), the thermal head 12 separates from the platen roller 10. In this case, the processor 102 stops the power supply to the thermal head 12 via the connector unit 22, at a time in a period of time during which the printer cover 3 starts moving from the closed position until reaches the open position (i.e., a period of time during which the thermal head 12 is separated from the platen roller 10).

In one example, the printer 1 includes a lock sensor (not illustrated), and this lock sensor detects whether the printer cover 3 is fixed or not by the cover locks 24. When the lock sensor detects the cancellation of the fixing of the printer cover 3 (i.e., separation of the platen roller 10 from the thermal head 12), the processor 102 stops the power supply to the thermal head 12.

In another example, the printer 1 includes a cover sensor to detect the position of the printer cover 3. When the cover sensor detects the printer cover 3 being located between the closed position and the open position (i.e., the platen roller 10 separates from the thermal head 12), the processor 102 stops the power supply to the thermal head 12.

In case of an incorrect connection, no current flows through the thermal head 12 after the power supply stops. This can prevent short circuit of the thermal head 12 during the replacement of the thermal head 12.

When the user rotates the printer cover 3 from the open position (FIG. 3) to the closed position (FIG. 2), the processor 102 restarts the power supply to the thermal head 12 via the connector unit 22. Specifically, when the cover sensor detects the printer cover 3 being located at the closed position (i.e., the platen roller 10 does not separate from the thermal head 12), the processor 102 restarts the power supply to the thermal head 12. That is, the user can restart the power supply to the thermal head 12 simply by placing the printer cover 3 at the closed position. Therefore, no instruction to restart the power supply is required. This can reduce the user's labor to replace the thermal head 12.

(5) SUMMARY

As stated above, the processor 102 of the present embodiment is configured to stop the power supply to the thermal head 12 via the connector unit 22 when the platen roller 10 and the thermal head 12 are separated. In case of an incorrect connection during the attachment of the thermal head 12 to the connector unit 22, no current flows through the thermal head 12. This can prevent short circuit of the thermal head 12 during the replacement of the thermal head 12.

(6) MODIFIED EXAMPLES

The following describes modified examples of the present embodiment.

(6-1) Modified Example 1

The following describes Modified Example 1. Modified Example 1 shows an example of controlling the power supply based on whether the thermal head 12 is fixed or not.

The printer 1 of Modified Example 1 includes a head lock member (not illustrated) and a head lock sensor (not illustrated).

The thermal head 12 of Modified Example 1 can move while keeping a connection to the connector unit 22. The user is allowed to move the thermal head 12 connected to the connector unit 22, and so the user can easily see such a thermal head 12 connected to the connector unit 22. Therefore, the user can easily attach and detach the thermal head 12 and the connector unit 22.

The head lock member is configured to fix the position of the thermal head 12 (FIG. 7) connected to the connector unit 22. The head lock member may be a lever, for example.

The head lock sensor detects whether the fixing by the head lock member is cancelled or not.

When the fixing by the head lock member is cancelled, the processor 102 stops the power supply to the thermal head 12 via the connector unit 22. Specifically, when the head lock sensor detects the cancellation of the fixing by the head lock member, the processor 102 stops the power supply to the thermal head 12 via the connector unit 22. In case of an incorrect connection, no current flows through the thermal head 12 after the power supply stops. This can prevent short circuit of the thermal head 12 due to incorrect connection.

When the head lock member fixes the position of the thermal head 12 connected to the connector unit 22, the processor 102 restarts the power supply to the thermal head 12 via the connector unit 22. Specifically, when the head lock sensor detects the fixing of the thermal head 12 by the head lock member, the processor 102 restarts the power supply to the thermal head 12 via the connector unit 22. That is, the user can restart the power supply to the thermal head 12 simply by fixing the thermal head 12 connected to the connector unit 22 using the head lock member. Therefore, no instruction to restart the power supply is required. This can reduce the user's labor to replace the thermal head 12.

(6-2) Modified Example 2

The following describes Modified Example 2. Modified Example 2 shows an example of controlling the power supply to a printer configured to print information using an ink ribbon.

The print surface PLa in Modified Example 2 does not include a thermosensitive layer.

Instead, the printer 1 of Modified Example 2 includes a ribbon cartridge (not illustrated), a ribbon supplier (not illustrated), a print head (not illustrated) and a ribbon sensor (not illustrated).

The ribbon cartridge stores an ink ribbon. The ink ribbon includes a paper core and a ribbon wound around the paper core (i.e., a roll of ribbon).

The ribbon cartridge has a ribbon shaft (one example of a ribbon holding part). The ribbon shaft holds the paper core. The ribbon shaft can move between a holding position (one example of a first position) and a not-holding position (one example of a second position). When the ribbon shaft is at the holding position, the ribbon cartridge holds the ink ribbon. In this case, the ribbon supplier can supply the ink ribbon. When the ribbon shaft is at the not-holding position, a user can replace the ink ribbon.

The ribbon sensor detects the position of the ribbon shaft.

The ribbon supplier is configured to supply the ink ribbon held by the ribbon shaft to the thermal head 12. The platen roller 10 and the thermal head 12 sandwich the print medium P fed by the platen roller 10 and the ink ribbon supplied by the ribbon supplier therebetween.

When the ribbon shaft is separated from the holding position, the processor 102 stops the power supply to the thermal head 12 via the connector unit 22.

Specifically, when the ribbon sensor detects the separation of the ribbon shaft from the holding position (i.e., separation of the platen roller 10 from the thermal head 12), the processor 102 stops the power supply to the thermal head 12 via the connector unit 22. In case of an incorrect connection, no current flows through the thermal head 12 after the power supply stops. This can prevent short circuit of the thermal head 12 due to incorrect connection.

When the ribbon shaft moves to the holding position, the processor 102 restarts the power supply to the thermal head 12 via the connector unit 22. Specifically, when the ribbon sensor detects the ribbon shaft located at the holding position (i.e., the platen roller 10 does not separate from the thermal head 12), the processor 102 restarts the power supply to the thermal head 12 via the connector unit 22. That is, the user can restart the power supply simply by moving the ribbon shaft to the holding position. Therefore, no instruction to restart the power supply is required. This can reduce the user's labor to replace the thermal head 12.

(6-3) Modified Example 3

The following describes Modified Example 3. In Modified Example 3, once the power supply to the thermal head 12 via the connector unit 22 stops, the power supply restarts after detecting correct connection of the thermal head 12 and the connector unit 22.

The connector unit 22 of Modified Example 3 includes a check circuit. The check circuit includes a switch. The switch is configured to switch between ON and OFF based on whether the thermal head 12 and the connector unit 22 are correctly connected or not.

The processor 102 is configured to flow predetermined check current through the check circuit and detect a predetermined voltage across the check circuit.

The switch turns ON when the thermal head 12 and the connector unit 22 are correctly connected. When the switch turns ON, check current flows through the check circuit. When the check current flows through the check circuit, the processor 102 detects a predetermined voltage across the check circuit. The processor 102 detects the correct connection between the thermal head 12 and the connector unit 22 by detecting the predetermined voltage across the check circuit. In this case, the processor 102 restarts the power supply to the thermal head 12 via the connector unit 22.

In case of incorrect connection between the thermal head 12 and the connector unit 22, the switch turns OFF. When the switch turns OFF, no current flows through the check circuit. Therefore, the processor 102 does not detect a predetermined voltage across the check circuit. In this case, the processor 102 does not restart the power supply to the thermal head 12 via the connector unit 22.

As described above, in Modified Example 3, the processor 102 detects correct connection between the thermal head 12 and the connector unit 22 based on the detection result of voltage across the check circuit. When detecting the correct connection between the thermal head 12 and the connector unit 22, the processor 102 restarts the power supply to the thermal head 12 via the connector unit 22. This can prevent short circuit of the 12 more reliably.

(6-4) Modified Example 4

The following describes Modified Example 4. In Modified Example 4, a user moves the thermal head 12 instead of the connector unit 22 to attach and detach the thermal head 12 and the connector unit 22.

In one example, a head bracket 20 of FIG. 5 has a pair of engagement holes. The head bracket 20 holds the thermal head 12. The pair of gears 23 engages with the pair of engagement holes of the head bracket 20 and not with the pair of engagement holes 22*f*. That is, the head cover 21 joins with the thermal head 12 held by the head bracket 20 via the pair of gears 23. When a user rotates the head cover 21 clockwise around the rotary shaft RS2 of FIG. 9, the head bracket 20 moves downward (LO) (i.e., in the direction toward the connector unit 22) with the rotation of the gears 23 while holding the thermal head 12.

As stated above, in Modified Example 4, the moving mechanism moves the head bracket 20 with the motion of the head cover 21. Attachment or detachment of the thermal head 12 and the connector unit 22 occurs with the motion of the head bracket.

(6-5) Modified Example 5

The following describes Modified Example 5. In Modified Example 5, power supply to the thermal head 12 is controlled based on whether a head unit including the thermal head 12 is separated or not from the platen roller 10.

(6-5-1) Structure of Printer

Figure 11:
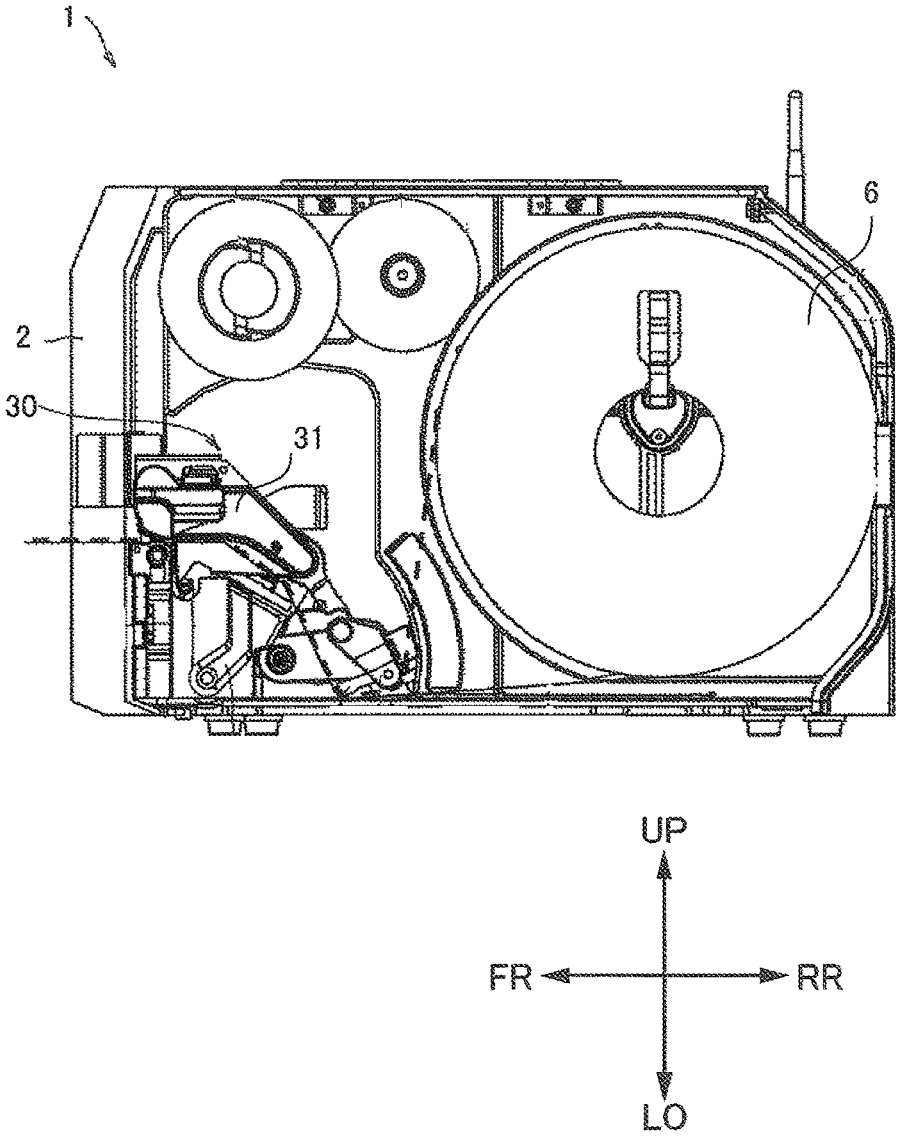
FIG. 11 schematically shows the internal structure of a printer according to modified example 5.

The following describes the structure of a printer of Modified Example 5. FIG. 11 schematically shows the internal structure of a printer according to modified example 5. FIG. 12 is an enlarged view of the print unit of FIG. 11.

As shown in FIG. 11, the printer of Modified Example 5 includes a print unit 30. The print unit 30 is located forward (FR) of the container 6.

Figure 12A:
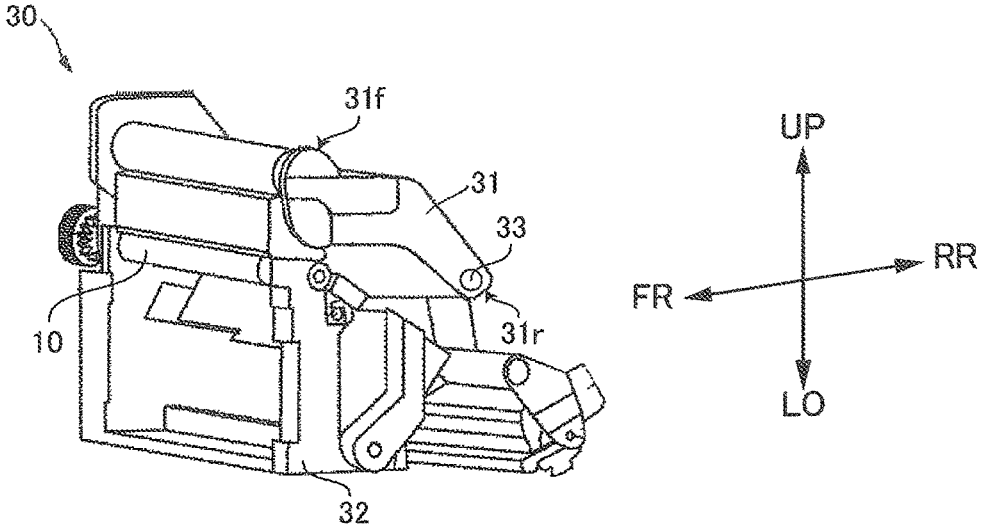
FIG. 12 is an enlarged view of a print unit of FIG. 11.

As shown in FIG. 12A, the print unit 30 includes a head unit 31, a feed unit 32, and a shaft 33.

The feed unit 32 includes the shaft 33 and the platen roller 10.

The head unit 31 has a rear end 31*r*, and the rear end is pivotally supported at the shaft 33. The head unit 31 is rotatable relative to the feed unit 32 about the shaft 33. The head unit 31 has a front end 31*f*, and the front end is a free end. The rear end 31*r* is a fixed end. That is, the head unit 31 can be open or closed relative to the feed unit 32.

FIG. 12A shows the head unit 31 at the closed position that closes the feed unit 32. At the closed position, the front end 31*f* is located above (UP) the platen roller 10. That is, the head unit 31 covers the region above (UP) the feed unit 32. In this way, the head unit 31 at the closed position closes the feed unit 32.

Figure 12B:
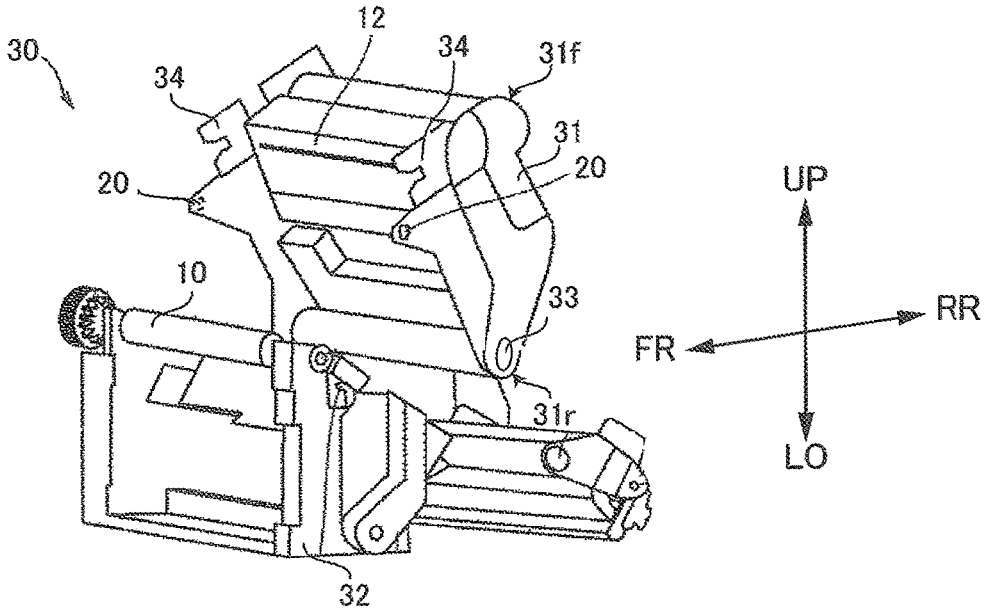

FIG. 12B shows the head unit 31 at the open position that opens the feed unit 32. At the open position, the front end 31*f* is separated from the platen roller 10. That is, the head unit 31 opens the region above (UP) the feed unit 32. In this way, the head unit 31 at the open position opens the feed unit 32.

The head unit 31 includes the thermal head 12 and the engagement part 34.

The thermal head 12 is located on the lower face of the head unit 31. As shown in FIG. 12B, when the head unit 31 is at the open position, the thermal head 12 is separated from the platen roller 10.

The engagement part 34 engages with the shaft (not illustrated) of the platen roller 10. When the head unit 31 rotates so that the front end 31*f* in FIG. 12B moves forward (FR), the engagement part 34 engages with the shaft of the platen roller 10. This results in the head unit 31 located at the closed position as shown in FIG. 12A.

A sensor (not illustrated) is disposed along the shaft of the platen roller 10. The sensor generates an electrical signal indicating "contact" or "non-contact" between the shaft of the platen roller 10 and the engagement part 34. Such an electrical signal generated by the sensor indicates whether the head unit 31 is at the closed position or not.

When the electrical signal generated by the sensor indicates "contact", the processor 102 supplies power to the thermal head 12. That is, when the head unit 31 is at the closed position, power is supplied to the thermal head 12.

To replace the thermal head 12, a user is required to cancel the engagement of the head unit 31 with the feed unit 32 and rotate the head unit 31 so that the front end 31*f* moves rearward (RR).

When the engagement part 34 separates from the shaft of the platen roller 10, the sensor generates an electrical signal indicating "non-contact" (i.e., separation of the platen roller 10 and the thermal head 12). In this case, the processor 102 stops the power supply to the thermal head 12. That is, when the head unit 31 separates from the closed position, the power supply to the thermal head 12 stops.

As stated above, in Modified Example 5, the power supply to the thermal head 12 switches based on whether the feed unit 32 including the platen roller 10 and the head unit 31 including the thermal head 12 separate or not. Particularly when the user moves the head unit 31 at the closed position to the open position to replace the thermal head 12, the power supply to the thermal head 12 stops. This can prevent short circuit of the thermal head 12 more reliably.

(6-6) Modified Example 6

The following describes Modified Example 6. In Modified Example 6, the power supply to the thermal head 12 is controlled in accordance with the progress of print.

The processor 102 stops the power supply to the thermal head 12 via the connector unit 22 when the print ends.

In one example, the processor 102 stops the power supply after the elapse of a certain period of time from the reception of print data.

In another example, when the user touches one of the operation key images displayed on the touch panel display 4 to instruct printing on the designated number of labels PL, the processor 102 creates print data for printing on the designated number of labels PL via the input/output interface 103. The processor 102 controls to print on the designated number of labels PL in accordance with the print data. When the printing on the designated number of labels PL ends, the processor 102 stops the power supply.

When the thermal head 12 is connected to the processor 22 as shown in FIG. 7 and when the processor 102 receives print data, then the processor 102 restarts the power supply to the thermal head 12 via the connector unit 22. That is, the user can restart the power supply to the thermal head 12 simply by placing the head cover 21 to the shielding position. Therefore, no instruction to restart the power supply is required. This can reduce the user's labor to replace the thermal head 12.

(7) OTHER MODIFIED EXAMPLES

The following describes other modified examples.

The above embodiments exemplify the print medium P having the liner PM and the labels PL, and the print medium P is not limited to this. The print medium P may be a label PL without a liner PM, for example.

That is detailed descriptions on the embodiments of the present invention, and the scope of the present invention is not limited to these embodiments. The above embodiments can be modified or changed variously without departing from the scope of the present invention. The above embodiments and modified examples can be combined.

DESCRIPTION OF REFERENCE NUMERALS

1 printer
2 front panel
2*a* label ejection port
2*b* liner ejection port
3 printer cover
3*a* cover open button
4 touch panel display
6 container
8 housing
10 platen roller
12 thermal head
12*b* connector
13 first assisting roller
14 second assisting roller
15 separator
16 first nip roller
17 second nip roller
20 head bracket
20*a* convex
20*b* protrusion
20*d* head bracket body
21 head cover
21*a* engagement part
21*b* gear
22 connector unit
22*a* terminal
22*f* engagement hole
23 gear
24 cover lock
25 cover lock hole
30 print unit
31 head unit
32 feed unit
33 shaft
34 engagement part
100 control board
101 memory
102 processor
103 input/output interface
104 communication interface

The invention claimed is:

1. A printer, comprising:
a platen roller configured to feed a print medium;
a print head configured to print on the print medium fed by the platen roller;
a connector that is attachable and detachable with respect to the print head; and
a controller configured to stop a power supply to the print head via the connector, while the connector is being attached to the print head, when the platen roller and the print head are separated.

2. The printer according to claim 1, further comprising:
a housing; and
a printer cover that is movable between a closed position at which the housing is closed and an open position at which the housing is open,
wherein the controller stops the power supply to the print head via the connector at a time in a period of time during which the printer cover starts moving from the closed position until reaches the open position.

3. The printer according to claim 2, wherein the controller restarts the power supply after the print head has been connected to the connector.

4. The printer according to claim 2, further comprising:
at least one cover lock configured to fix the printer cover at the closed position; and
a lock sensor configured to detect whether the printer cover is fixed by the cover locks,
wherein the controller stops power supply to the print head via the connector, when the lock sensor detects that fixing of the printer cover is cancelled.

5. The printer according to claim 2, further comprising a cover sensor configured to detect a position of the printer cover,
wherein the controller stops power supply to the print head via the connector, when the cover sensor detects the printer cover being located in an intermediate position between the closed position and the open position.

6. The printer according to claim 1, further comprising:

a feed unit including the platen roller; and a head unit that is movable between an open position at which the feed unit is open and a closed position at which the feed unit is closed, the head unit including the print head, wherein the controller stops the power supply to the print head when the head unit is separated from the closed position.

7. The printer according to claim 6, wherein the controller restarts the power supply after the print head has been connected to the connector.

8. The printer according to claim 1, further comprising a head cover of the print head, the head cover being movable between a first position at which the print head is shielded and a second position at which the print head is not shielded, wherein the controller stops the power supply at a time in a period of time during which the head cover starts moving from the first position until reaches the second position.

9. The printer according to claim 8, wherein the controller restarts the power supply after the print head has been connected to the connector.

10. The printer according to claim 1, wherein when the controller determines that the connector is disconnectable from the print head, the controller stops the power supply to the print head via the connector.

11. The printer according to claim 10, wherein the controller restarts the power supply after the print head has been connected to the connector.

12. The printer according to claim 1, wherein the controller restarts the power supply after the print head has been connected to the connector.

13. The printer according to claim 12, wherein the controller restarts the power supply, when the controller detects correct connection between the print head and the connector after the power supply stops.

14. The printer according to claim 1, further comprising a moving mechanism configured to move the connector in a first direction closer to the print head and configured to move the connector in a second direction away from the print head such that the connector is attachable and detachable with respect to the print head.

15. The printer according to claim 1, further comprising:

a head lock member configured to fix a position of the print head attached to the connector; and a head lock sensor configured to detect whether fixing of the position of the print head by the head lock member is cancelled, wherein the controller stops power supply to the print head via the connector, when the head lock sensor detects that fixing of the position of the print head by the head lock member is cancelled.

16. The printer according to claim 1, further comprising:

a first unit including a shaft and a platen roller;

a second unit including the print head and an engagement part configured to engage with the shaft of the platen roller, the second unit being located at an open position or a closed position by rotating about the shaft relative to the first unit, the second unit at the open position opening the first unit, the second unit at the closed position closing the first unit; and a sensor configured to detect whether the second unit is located at the closed position, wherein the controller stops power supply to the print head via the connector, when it is determined from a signal of the sensor that the second unit separates from the closed position.

17. A printer, comprising:

a platen roller configured to feed a print medium;

a print head configured to print on the print medium fed by the platen roller;

a connector that is attachable and detachable with respect to the print head;

an engagement part configured to engage with a shaft of the platen roller; and a controller configured to stop power supply to the print head via the connector, when it is detected that the engagement part is not in contact with the shaft of the platen roller.

* * * * *